US005516064A

United States Patent [19]

Hsieh

[11] Patent Number: 5,516,064

[45] Date of Patent: May 14, 1996

[54] FOLD-AWAY GOLF BAG STAND

[76] Inventor: Chi-Chung Hsieh, 6F-2, No. 67, Sung Chaing Road., Taipei, Taiwan

[21] Appl. No.: 279,394

[22] Filed: Jul. 25, 1994

[51] Int. Cl.[6] ..... A63B 55/00

[52] U.S. Cl. ..... 248/96; 248/688

[58] Field of Search ..... 248/96, 171, 169, 248/688, 136, 150; 206/315.8, 315.7, 315.3

[56] References Cited

U.S. PATENT DOCUMENTS

| | | | |
|---|---|---|---|
| 1,686,774 | 10/1928 | Sperry | 248/96 |
| 1,970,849 | 8/1934 | Gunther | 248/96 |
| 4,226,389 | 10/1980 | Neth | 248/96 |
| 4,834,235 | 5/1989 | Solheim et al. | 248/96 X |
| 5,152,483 | 10/1992 | Maeng | 206/315.7 X |
| 5,178,273 | 1/1993 | Igarashi | 248/96 X |
| 5,339,951 | 8/1994 | Chen | 248/96 X |
| 5,340,063 | 8/1994 | Hsieh | 248/96 |
| 5,351,921 | 10/1994 | Chen | 248/688 X |
| 5,415,285 | 5/1995 | Reimers | 248/96 X |

*Primary Examiner*—Karen J. Chotkowski

*Attorney, Agent, or Firm*—Morton J. Rosenberg; David I. Klein

[57] ABSTRACT

A fold-away golf bag stand including three mounting frames fixed to a golf bag at different elevations, two legs bilaterally pivoted to the top mounting frame and having a respective lug near the top, a spring connected between the lugs of the legs, two slides respectively mounted around and moved along the legs, two links respectively pivotally connected between the intermediate mounting frame and the slides, and a supporting frame having two opposite ends respectively pivotally connected to the lugs of the legs and a middle part releasably fastened to a hook on the bottom mounting frame.

4 Claims, 9 Drawing Sheets

FOLD-AWAY GOLF BAG STAND

BACKGROUND OF THE INVENTION

The present invention relates to fold-away golf bag stands, and relates more particularly to such a fold-away stand which is suitable for PE-cylinder construction rigid bags as well as side-stay construction bags.

Various fold-away golf bag stands have been disclosed for supporting golf bags in standing positions. The present inventor invented a fold-away golf bag stand and filed for a patent on May 21, 1993 under U.S. patent application Ser. No. 08/064237. However, this structure of fold-away golf bag stand is suitable only for a PE-cylinder construction rigid bag but not applicable for a side-stay construction bag.

SUMMARY OF THE INVENTION

The principal object of the present invention is to provide a fold-away golf bag stand which is suitable for use with a PE-cylinder construction rigid bag as well as a side-stay construction bag.

According to one embodiment of the present invention, the fold-away golf bag stand including a top mounting frame, an intermediate mounting frame and a bottom mounting frame respectively fixed to a PE-cylinder construction rigid golf bag at different elevations, two legs bilaterally pivoted to the top mounting frame and having a respective lug near the top, a spring connected between the lugs of the legs, two slides respectively mounted around and moved along the legs, two links respectively pivotally connected between the intermediate mounting frame and the slides, and a supporting frame having two opposite ends respectively pivotally connected to the lugs of the legs and a middle part releasably fastened to a hook on the bottom mounting frame. For mounting on a side stay construction golf bag, an upright square bar is provided having a bottom end inserted into a pocket on the bottom cuff of the golf bag and then fixedly fastened to the bottom cuff, a top end fixedly fastened to the top mounting frame, and a middle part fixedly fastened to the intermediate mounting frame. The upright square bar may be installed inside the golf bag or outside the golf bag alternatively.

DETAILED DESCRIPTION OF THE PREFERRED EMBODIMENT

Figure 1:
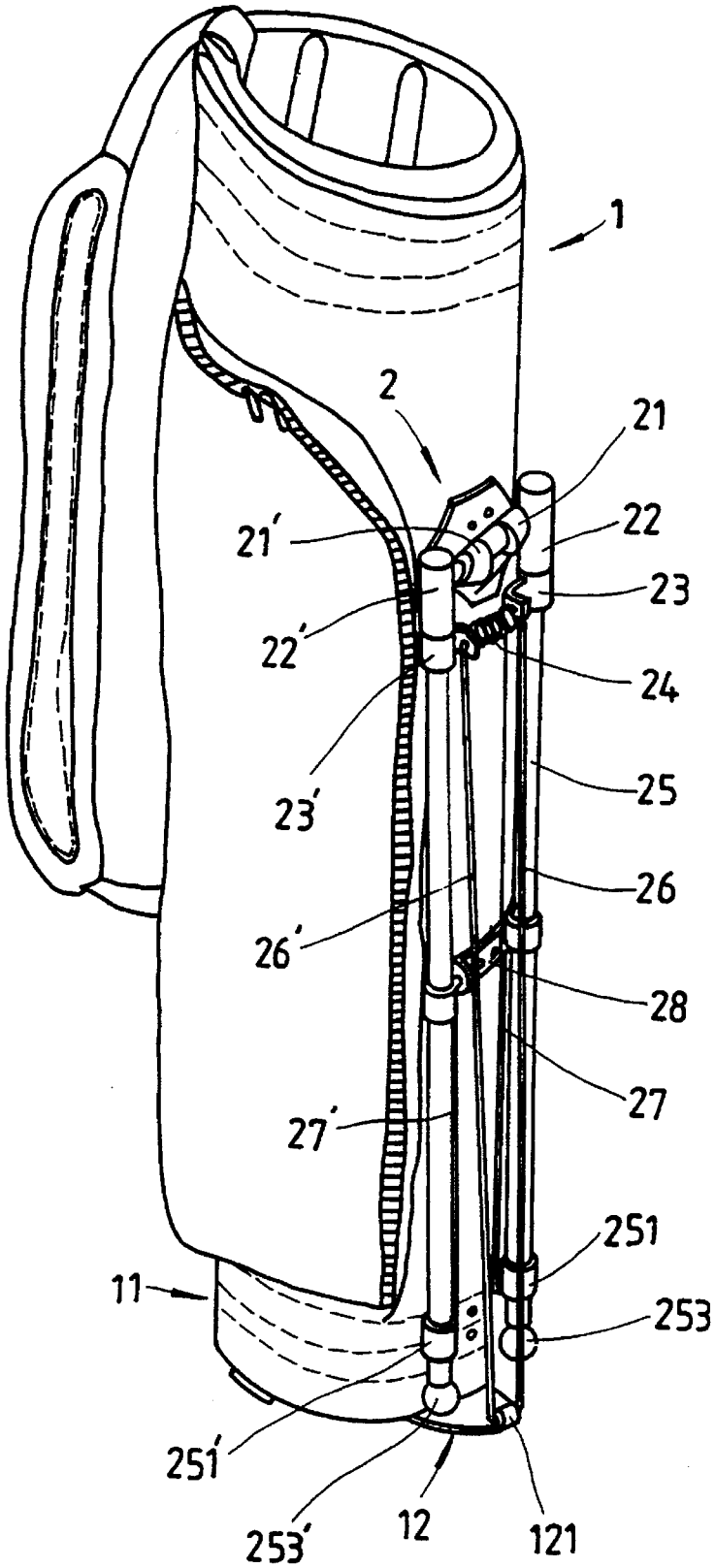
FIG. 1 is an installed view of a fold-away golf bag stand according to a first embodiment of the present invention.
Figure 2:
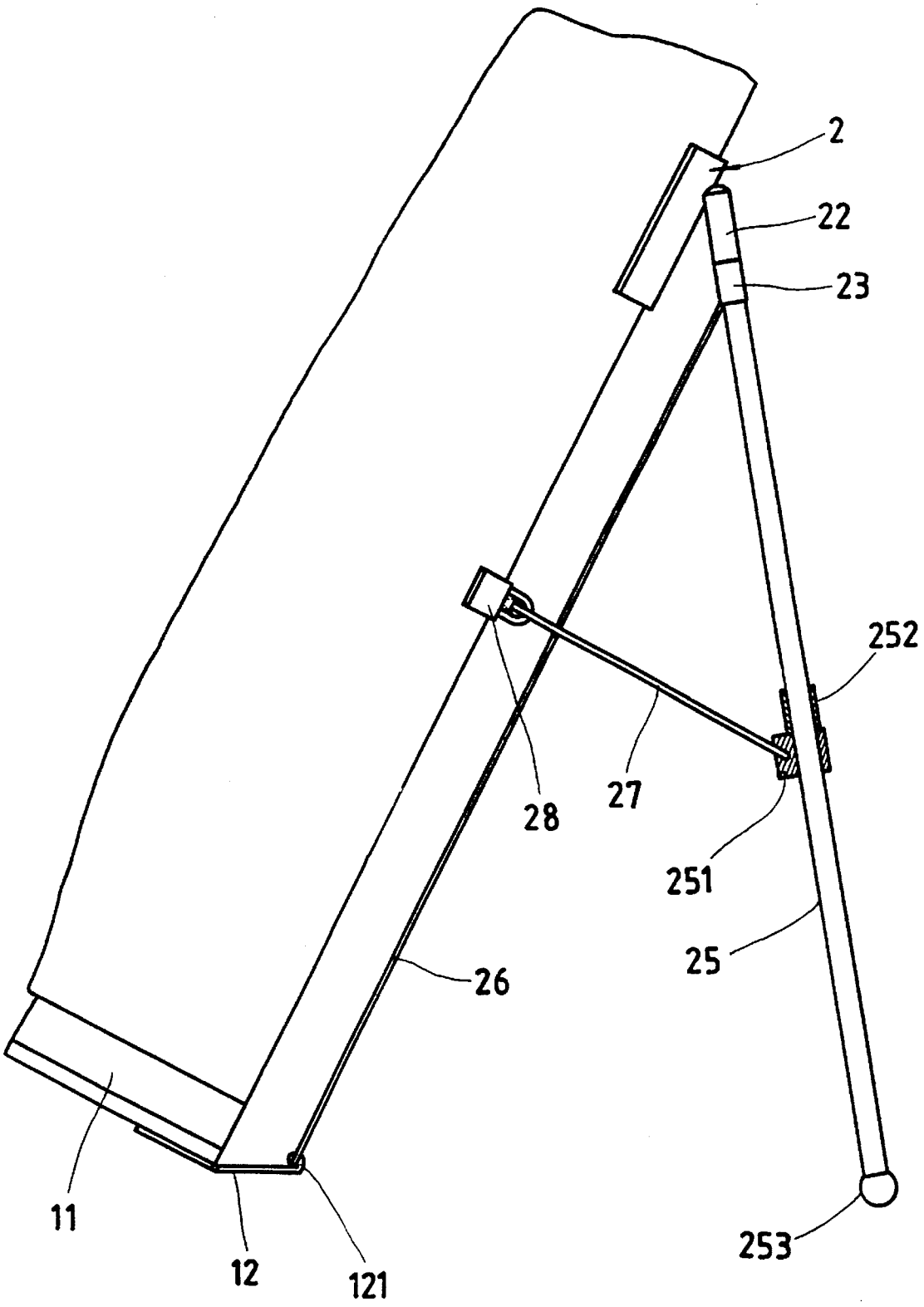
FIG. 2 is a plain view of the fold-away golf bag stand showing the legs extended out.
Figure 3:
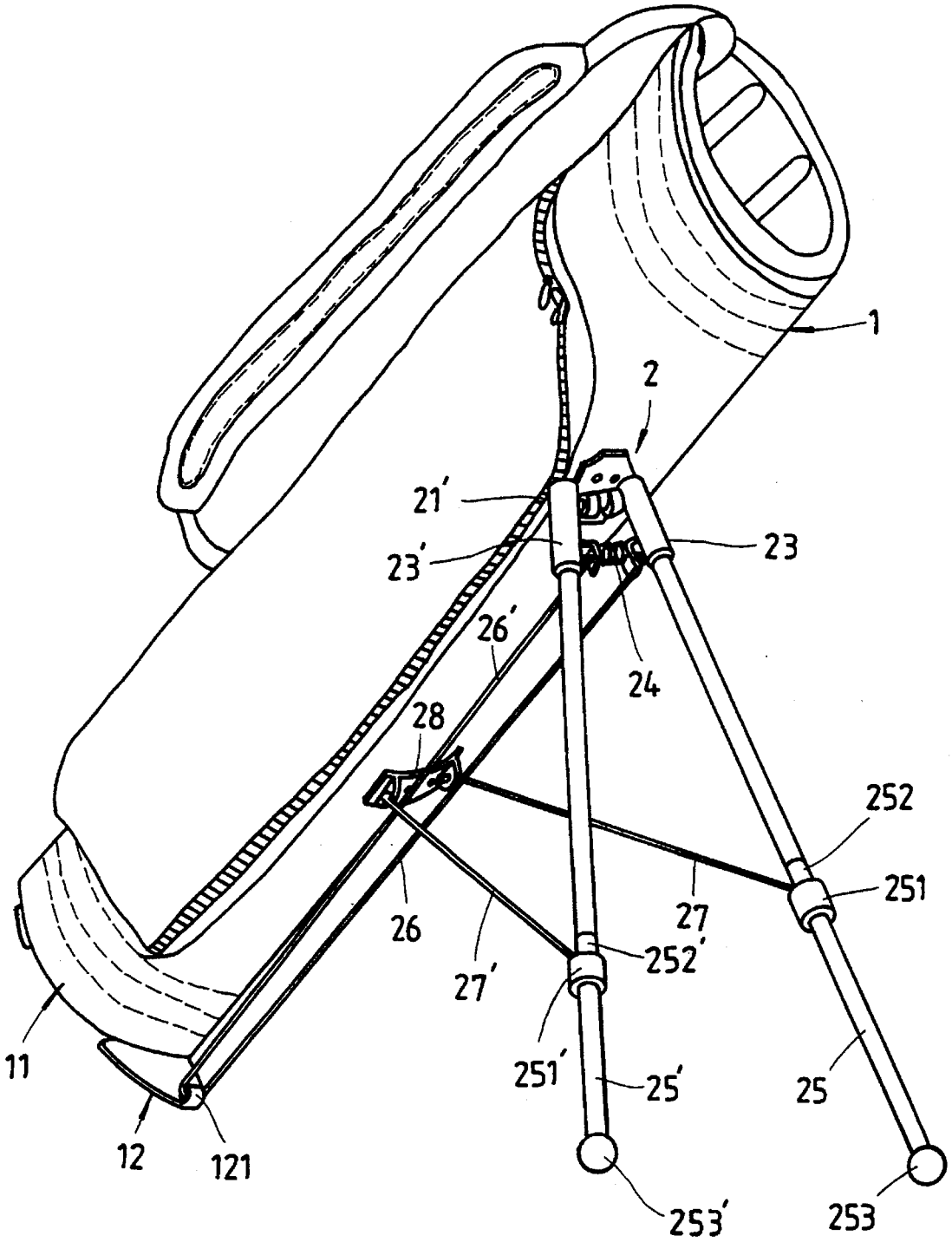
FIG. 3 is an elevational view of the fold-away golf bag stand showing the golf bag supported by the legs in a sloping position.
Figure 4:
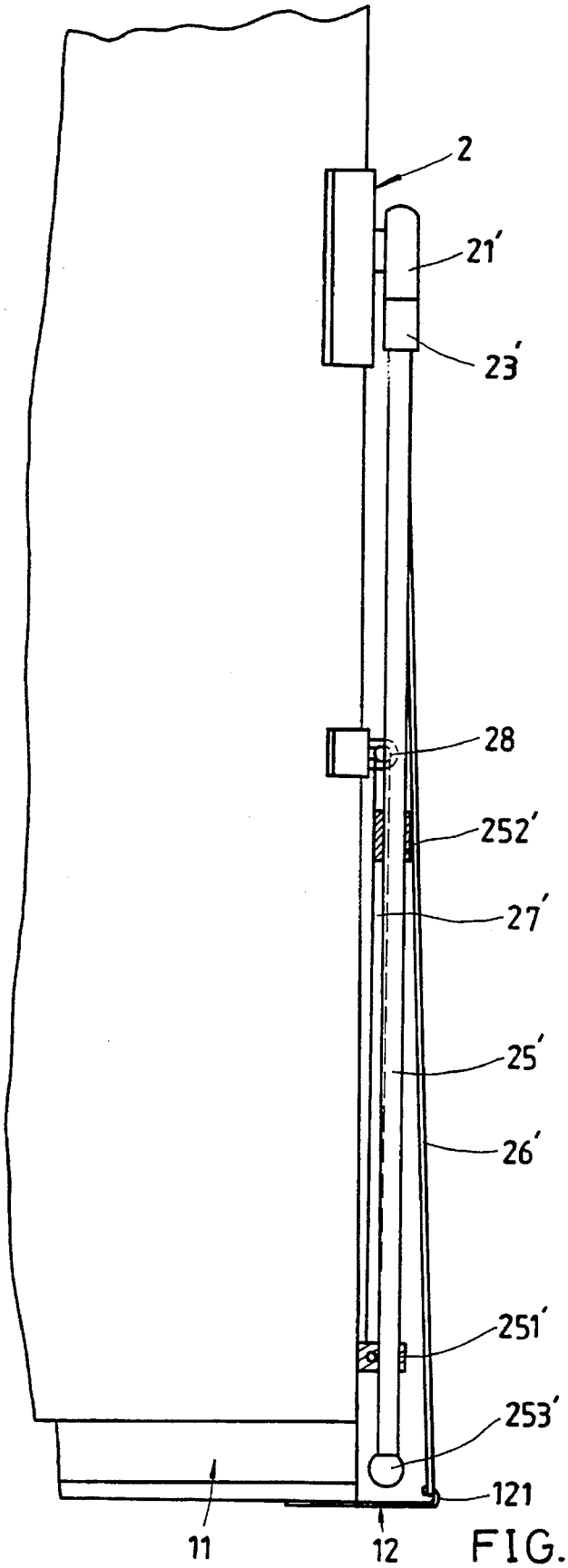
FIG. 4 is a side view showing the fold-away golf bag stand of FIG. 1 collapsed.
Figure 5:
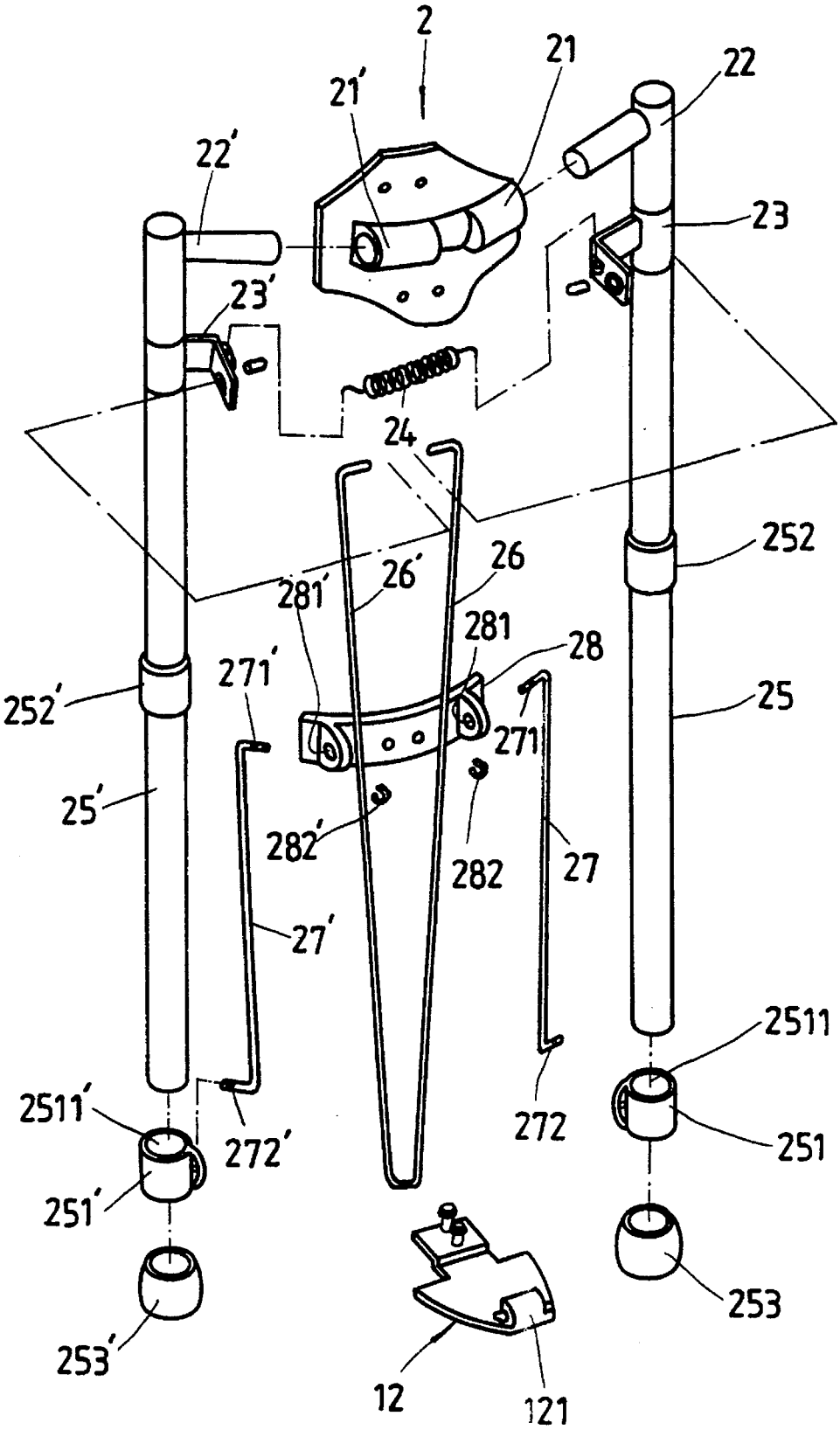
FIG. 5 is an exploded view of the fold-away golf bag stand of the present invention.

Referring to FIGS. 1, 2, 3, 4, and 5, a the PE-cylinder construction rigid bag 1 has a bottom cuff 11 mounted with an arrow-like bottom plate 12. A top mount 2 is fixedly mounted on the outside wall of the bag 1 near the top cuff thereof. The top mount 2 has two barrels 21 and 21' horizontally spaced in the middle for mounting two legs 25' and 25'. The leg 25 or 25' comprises a pivot rod 22 or 22' perpendicularly disposed at the top and pivotally fastened to the barrel 21 or 21', a collar 252 or 252' in the middle, a lug 23 or 23' spaced between the pivot rod 22 or 22' and the collar 252 or 252' and disposed near the pivot rod 22 or 22', a bottom cap 253 or 253' fastened at the bottom, and a slide 251 or 251' moved between the bottom cap 253 or 253' and the collar 252 or 252'. The slide 251 or 251' has a center through hole 2511 or 2511, into which the leg 25 or 25' inserts. A spring 24 is connected between the lugs 23 and 23'. Two supporting rods 26 and 26' are respectively connected to the lugs 23 and 23'. The opposite ends of the supporting rods 26 and 26' are joined in integrity and releasably fastened to a hook 121 on the arrow-like bottom plate 12. A mounting plate 28 is fixedly fastened to the outside wall of the bag 1 and spaced between the arrow-like bottom plate 12 and the top mount 2, having two lugs 281 and 281' raised from two opposite ends thereof at the same elevation. Two links 27 and 27' are provided having each one end 271 or 271 pivotally connected to the lug 281 or 281' of the mounting plate 28 and an opposite end 272 or 272' pivotally connected to the slide 251 or 251'. The bag 1 can be supported in a sloping position when the legs 25 and 25' are extended outwards from the bag 1 (see FIG. 3).

Figure 6:
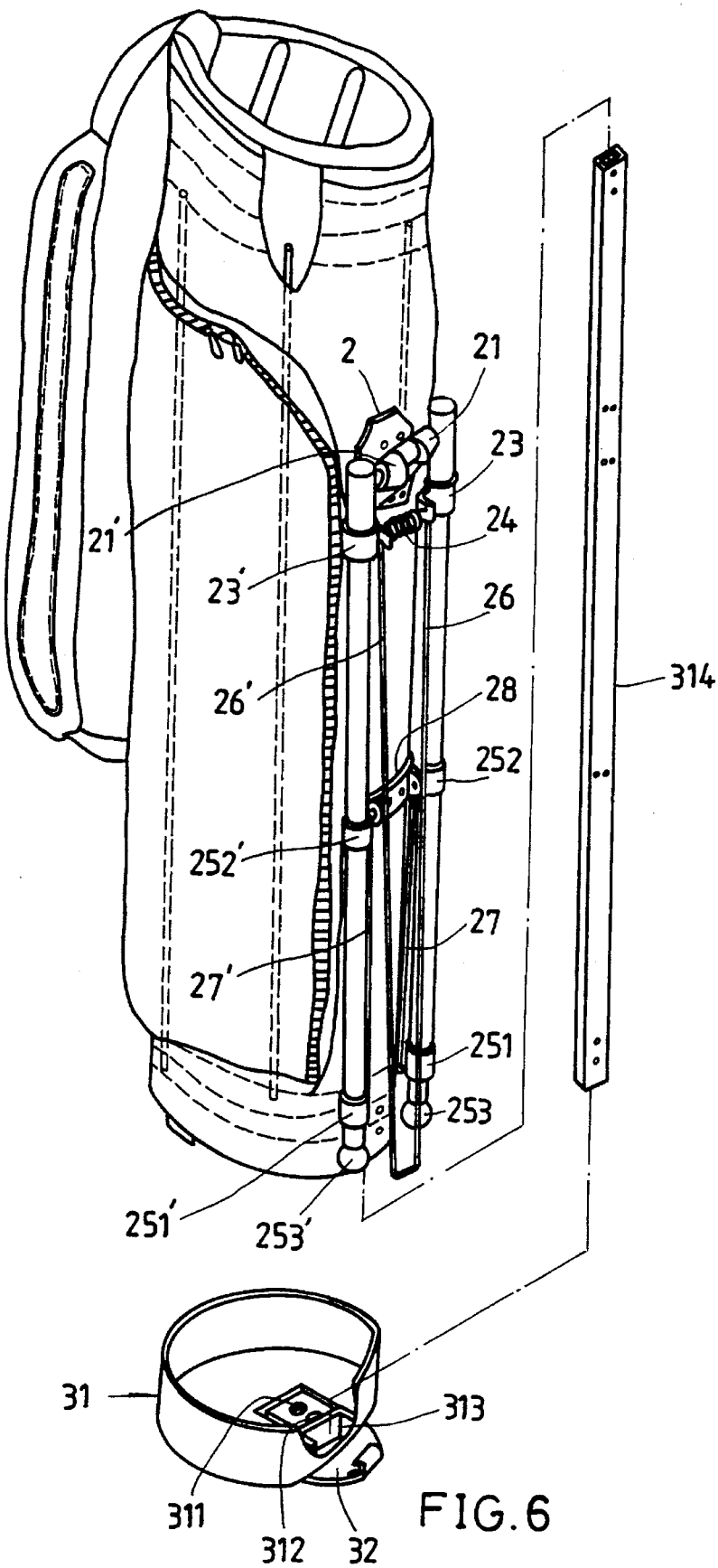
FIG. 6 shows an alternate form of the present invention.
Figure 7:
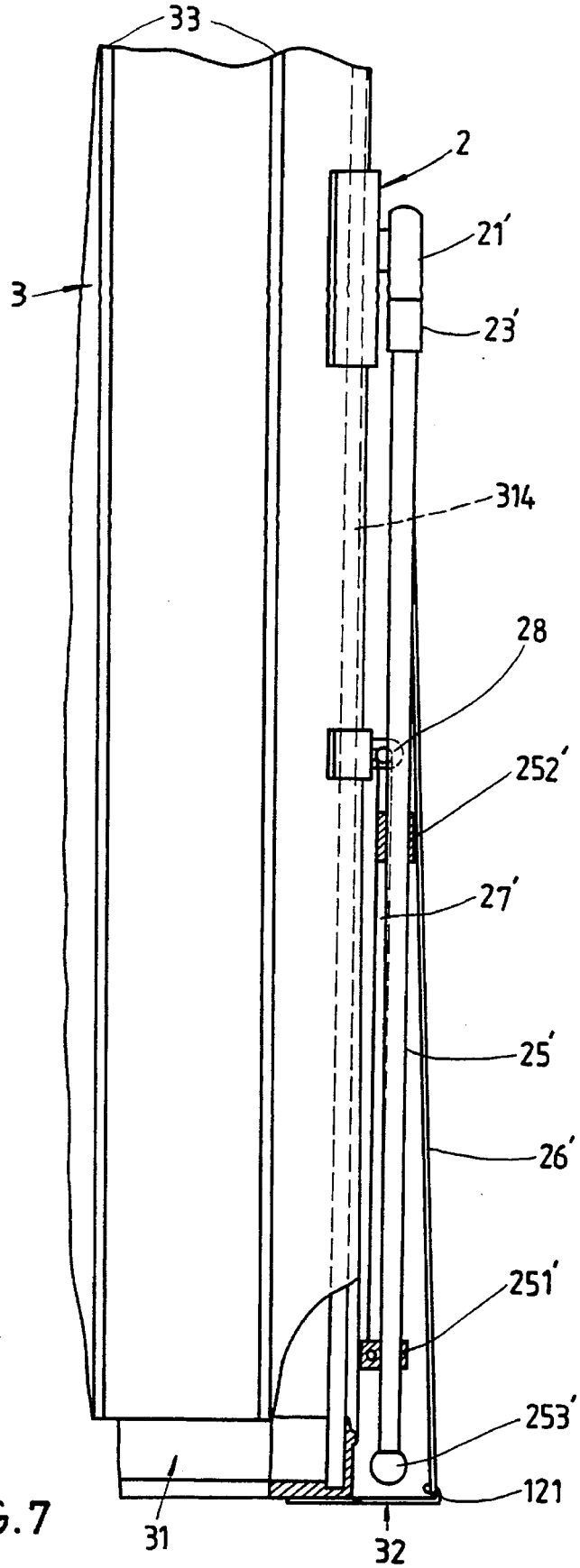
FIG. 7 shows the square bar of the alternate form of FIG. 6 installed.

Referring to FIGS. 6 and 7, therein illustrated is an alternate form of the present invention installed in a side-stay construction bag 3 having side stays 33. The bottom cuff 31 of the side-stay construction bag 3 has holes 311 and 312 at the bottom for mounting an arrow-like bottom plate 32 (equivalent to the arrow-like bottom plate 12 shown in FIG. 5), and a square pocket 313 for holding a square bar 14 inside the side-stay construction bag 3. The square bar 14 has a top end fixed to the top mount 2, a bottom end inserted into the pocket 313 and then fixed in place, and a middle part fixed to the mounting plate 28. Therefore, the side-stay construction bag 3 can be supported by the legs 25 and 25' in a sloping position.

Figure 8:
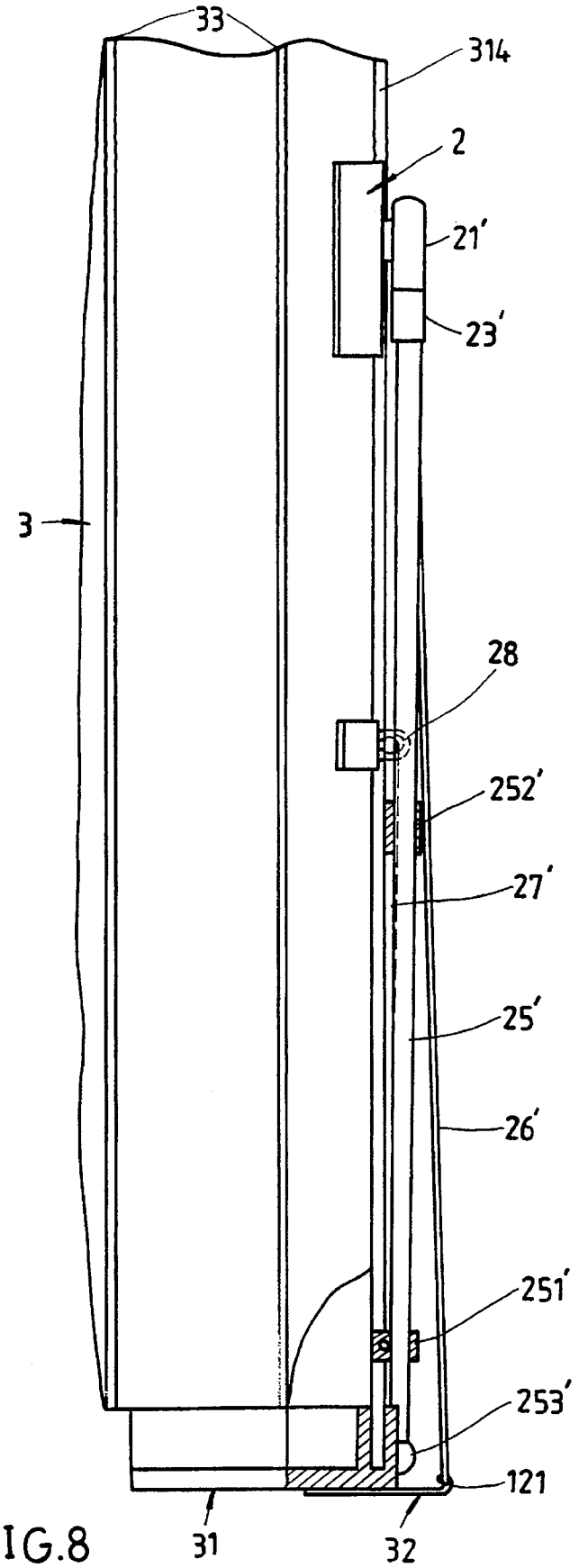
FIG. 8 shows another alternate form of the present invention.
Figure 9:
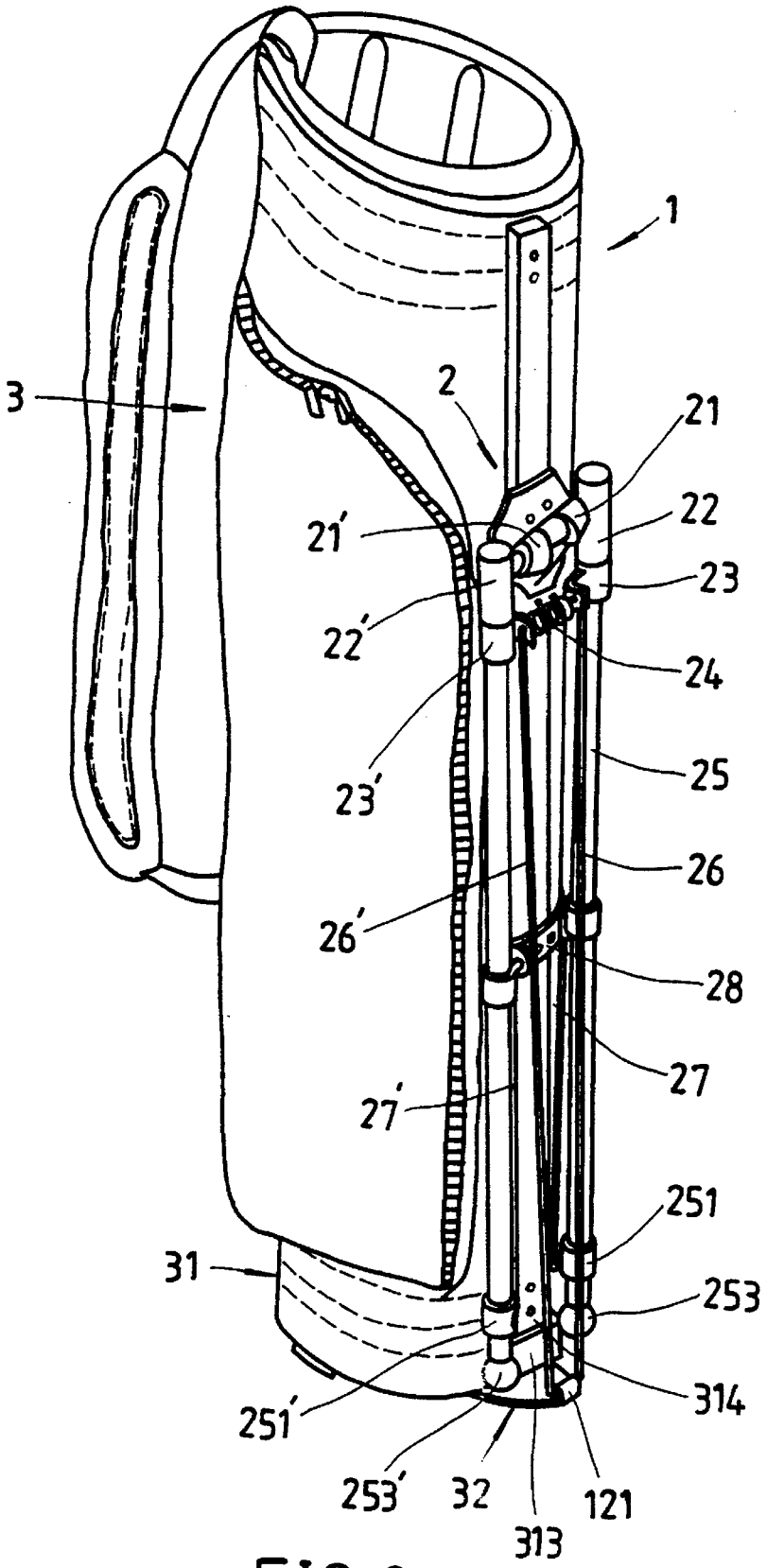
FIG. 9 is an elevational view of FIG. 8.

Referring to FIGS. 8 and 9, the square pocket 313 may be made on an outside block 314 of the bottom cuff 31 such that the square bar 14 can be fastened to the mounting plate 28 and the top mount 2 outside the side-stay construction bag 3.

What is claimed is:

1. A fold-away golf bag stand comprising:

a first mounting frame fixedly mounted on the outside wall of a golf bag near the top cuff, said first mounting frame having two barrels spaced at the same elevation;

a second mounting frame fixedly fastened to the bottom cuff of the golf bag, said second mounting frame having a front hook;

a third mounting frame fixedly fastened to the outside wall of the golf bag and spaced between said first mounting frame and said second mounting frame, said third mounting frame having two lugs spaced at the same elevation;

a first leg and a second leg respectively pivoted to said first mounting frame, each leg having a pivot rod perpendicularly disposed at the top and pivotally fastened to either barrel on said first mounting frame, a bottom cap at the bottom, a collar fixedly disposed in the middle and spaced between the pivot rod and the bottom cap, and a lug spaced between the collar and the pivot rod;

spring means connected between the lugs of said first and second legs;

two slides respectively mounted around said first and second legs and moved between the collar and bottom cap of either leg;

a supporting frame having two opposite ends respectively pivotally connected to the lug of either leg and a middle part releasably fastened to the front hook of said second mounting frame; and two links respectively linked between said slides and said third mounting frame, each link having one end pivotally connected to either lug of said third mounting frame and an opposite end pivotally connected to either slide.

2. The fold-away golf bag stand of claim 1 further comprising an upright square bar having a bottom end inserted into a pocket on the bottom cuff of the golf bag and fixedly fastened to the bottom cuff of the golf bag, a top end fixedly fastened to said first mounting frame, and a middle part fixedly fastened to said third mounting frame.

3. The fold-away golf bag stand of claim 2 wherein said upright square bar is disposed inside the golf bag.

4. The fold-away golf bag stand of claim 2 wherein said upright square bar is disposed outside the golf bag.

* * * * *